US011744316B2

(12) United States Patent
Grandin et al.

(10) Patent No.: US 11,744,316 B2
(45) Date of Patent: Sep. 5, 2023

(54) METHOD FOR THE CUSTOMIZATION OF A FOOTWEAR

(71) Applicant: Tecnica Group S.P.A., Giavera del Montello (IT)

(72) Inventors: Giorgio Grandin, Giavera del Montello (IT); Dino Maccari, Giavera del Montello (IT)

(73) Assignee: TECNICA GROUP S.P.A., Giavera del Montello (IT)

( * ) Notice: Subject to any disclaimer, the term of this patent is extended or adjusted under 35 U.S.C. 154(b) by 193 days.

(21) Appl. No.: 17/177,374

(22) Filed: Feb. 17, 2021

(65) Prior Publication Data

US 2021/0161243 A1 Jun. 3, 2021

Related U.S. Application Data

(62) Division of application No. 15/972,301, filed on May 7, 2018, now abandoned.

(30) Foreign Application Priority Data

May 8, 2017 (IT) ..... 102017000049643

(51) Int. Cl.
*A43B 1/14* (2006.01)
*A43B 5/00* (2022.01)
(Continued)

(52) U.S. Cl.
CPC ..... *A43B 1/14* (2013.01); *A43B 3/0084* (2013.01); *A43B 5/00* (2013.01); *A43B 5/002* (2013.01);
(Continued)

(58) Field of Classification Search
None
See application file for complete search history.

(56) References Cited

U.S. PATENT DOCUMENTS 3,613,271 A 10/1971 Geller
3,848,286 A 11/1974 Kahmann
(Continued)

OTHER PUBLICATIONS

Search Report and Written Opinion issued in connection with counterpart co-pending priority Italian Patent Application No. 10201700049643, dated Jan. 2018.

*Primary Examiner* — Jila M Mohandesi
(74) *Attorney, Agent, or Firm* — HOWSON & HOWSON LLP

(57) ABSTRACT

A method and kit are provided for the customization of footwear comprising an upper which is partially or totally made of thermoformable material. The method provides for selectively heating the portions made of thermoformable material of the footwear, while leaving the remaining portions of the footwear at a substantially unchanged temperature, and for applying to the thermoformable material portions a pressure sufficient to adapt their shape to the specific morphology of the user's foot. This allows to customize even footwear comprising delicate portions, which would be damaged if subjected to high temperatures. The method may provide for customizing a footbed, partially or totally made of thermoformable material, to the specific morphology of the user's foot sole. The kit is compact, preferably transportable and capable of autonomously carrying out all the steps of the method.

8 Claims, 5 Drawing Sheets

(51) Int. Cl.

| | |
|---|---|
| ***A43B 3/00*** | (2022.01) |
| ***A43D 3/08*** | (2006.01) |
| ***A43D 3/04*** | (2006.01) |
| ***A43D 3/14*** | (2006.01) |
| ***A43D 1/02*** | (2006.01) |

(52) U.S. Cl.
CPC ..... *A43D 1/02* (2013.01); *A43D 3/04* (2013.01); *A43D 3/08* (2013.01); *A43D 3/14* (2013.01)

(56) References Cited

U.S. PATENT DOCUMENTS 3,848,287 A * 11/1974 Simonsen ..... A43B 5/0405 12/142 P
4,964,229 A * 10/1990 Laberge ..... A43B 5/1666 36/93
5,275,775 A * 1/1994 Riecken ..... A61F 5/14 12/142 N
5,940,991 A 8/1999 Cabalquinto
9,221,211 B2 * 12/2015 Klein ..... B29C 51/10
10,182,615 B2 * 1/2019 Jacobsen ..... D06H 5/00 2/243.1
10,524,534 B2 * 1/2020 Smith ..... A43B 5/04
2002/0047228 A1 * 4/2002 Vachon ..... A43B 5/0415 264/322
2008/0000109 A1 * 1/2008 Challande ..... A43D 95/10 36/117.1
2009/0313835 A1 * 12/2009 Erbrick ..... B23D 21/10 30/251
2010/0199406 A1 * 8/2010 Dua ..... D06H 5/00 2/243.1
2010/0236101 A1 * 9/2010 Leitner ..... A43B 5/049 36/117.1
2011/0068023 A1 3/2011 Baker et al.
2013/0134638 A1 * 5/2013 Klein ..... B29C 51/10 264/510
2015/0342296 A1 * 12/2015 Skaja ..... A43B 23/026 36/83
2016/0100694 A1 * 4/2016 Pelletier ..... A61G 7/0755 5/648
2016/0279889 A1 * 9/2016 Grandin ..... A43B 5/04
2016/0302514 A1 * 10/2016 Martinazzo ..... A43B 5/04 36/117.1
2017/0273397 A1 9/2017 Smith
2017/0297286 A1 10/2017 Grandin et al.
2017/0368722 A1 12/2017 Jacobsen

* cited by examiner

METHOD FOR THE CUSTOMIZATION OF A FOOTWEAR

CROSS REFERENCE TO RELATED APPLICATIONS

This application is a divisional of co-pending U.S. application Ser. No. 15/972,301, filed May 7, 2018, which claims the benefit under 35 USC 119 of Italian Application No. 102017000049643, filed May 8, 2017.

BACKGROUND

The present invention relates to a method for the customization of a footwear, more particularly a sports footwear.

According to prior art, footwear are manufactured in a variety of sizes that are different in length and width. However, each footwear size has standard length and width and not all the users with the same foot size have feet with the same morphology. It results that, while the size is correct, the footwear often does not fit the particular morphology of the user's foot.

This drawback is particularly felt in the field of sports footwear, as the user's feet—during sports practice—are subject to considerable efforts. Moreover, in the field of sports footwear, the conformity of the footwear to the specific morphology of the particular user remarkably affects not only the user's comfort, but also his/her performances.

As a consequence, in the past, methods and arrangements were developed for the customization of sports footwear starting from a standard, non-customized footwear, which could therefore be manufactured on a large scale.

More particularly, methods and arrangements were developed which provide for totally or partially making the footwear from a thermoformable material, whereby its shape and size can be modified if it is heated to a temperature higher than a predetermined threshold. Said known methods and arrangements further provide that, once the footwear has been heated, a pressure is applied to the footwear from the outside, so that it is pressed against the user's foot.

In this respect, there can be cited U.S. Pat. No. 3,613,271, in which pressure is applied manually to the heated footwear (namely, the shell of a ski boot), or also U.S. Pat. No. 3,848,286, in which the footwear (namely a ski boot) is held under vacuum, whereby it is the atmospheric pressure of the surrounding environment that presses the footwear against the user's foot.

However, such methods and arrangements have several drawbacks.

First of all, according to prior art the heating step for bringing the thermoformable material beyond its softening temperature is typically carried out by using an oven, i.e. by heating the whole footwear.

This technique is not appropriate for footwear consisting of a plurality of components attached to each other, for instance glued to each other.

This is the case, for example, of hiking footwear, which in general comprise an outer sole, an inner sole and an upper (each of which possibly consists of a plurality of components joined together), which are attached to one another by means of glues.

Subjecting the whole hiking footwear to a heating step at high temperature would likely cause a deterioration of the used glues and, as a consequence, a separation, at least a partial separation, of the various components, which would irrevocably damage the footwear.

Footwear comprising an upper which is totally or partially made of delicate materials, which would be damaged if subjected to heating, represent another example of footwear to which the known methods and arrangements can hardly be applied.

Secondly, the known method and arrangements only allow to adapt the upper of the footwear to the morphology of the user's foot, while they do not allow to act onto the inner sole of the footwear, with which the foot sole is in contact during use.

On the other hand, it is evident that the foot sole is a part of the foot which is subjected to intense and/or prolonged stresses during use, especially during sports practice, and therefore there is the need for a footwear which is well adapted to the foot sole.

On the market there are universal footbeds made of soft material that can be cut to size for being adapted to the footwear size of the single user and that can be removably inserted between the foot and the inner sole of the footwear: under the user's weight, the soft material of which the footbeds is made is deformed in accordance with the morphology of the user's foot sole.

Nevertheless, using such footbeds cannot be considered as a satisfactory solution: as they are universal footbeds, they can only approximate the morphology of the user's foot sole, but they cannot perfectly adapt to it.

Moreover, using soft footbeds involves another drawback, as this can negatively affect the effective transmission of efforts from the user's foot to the outer sole of the sports footwear.

SUMMARY

It is an object of the present invention to overcome the drawbacks and limitations of prior art by providing a method for the customization of a footwear, more particularly a sports footwear, that is adapted to any kind of footwear.

It is another object of the present invention to overcome the drawbacks and limitations of prior art by providing a method for the customization of a footwear, more particularly a sports footwear, that allows to obtain a footwear which is completely adapted to the morphology of a single user.

These and other objects are achieved by the method as claimed in the appended claims.

According to its general concept, the method according to the invention comprises the steps of:

- providing a footwear with an upper which is partially or totally made of a thermoformable material;
- heating said thermoformable material until bringing its temperature above a first predetermined threshold (softening temperature);
- fitting the user's foot into said footwear;
- applying to said footwear, at least at the portion(s) made of said thermoformable material, a positive pressure or a negative pressure (vacuum) sufficient to make the thermoformable material adhere to the user's foot and to modify its shape accordingly;
- while said pressure is being applied, allowing the thermoformable material to cool down to a temperature lower than said predetermined threshold;
- wherein the heating step provides for selectively heating one or more portions of said footwear, while leaving the remaining portions of said footwear at a substantially unchanged temperature.

Advantageously, thanks to such arrangement it is possible to customize any kind of footwear, including those footwear which comprise one or more components attached to each other by gluing (namely by glues with a softening temperature lower than the softening temperature of the thermoformable material) and including those footwear which comprises portions made of delicate materials, which would be damaged if subjected to high temperatures.

According to the invention, the heating step provides for simultaneously heating said one or more portions of said footwear from the inside and from the outside of the footwear.

Thanks to such arrangement, it is advantageously possible to obtain that the selected portion(s) made of thermoformable material reach(es) the first predetermined temperature threshold quickly and while maintaining the temperature of the heating elements limited.

According to a preferred embodiment of the invention, the method according to the invention further comprises the steps of:

- providing a footbed which is partially or totally made of a thermoformable material;
- heating the footbed until bringing its temperature above a second predetermined threshold (softening temperature of the thermoformable material);
- fitting the thus heated footbed to the user's foot sole;
- applying to the user's foot, at least at the foot sole, a positive pressure or a negative pressure (vacuum) sufficient to make the footbed adhere to the user's foot sole and to modify its shape accordingly;
- while said pressure is being applied, allowing the footbed to cool down to a temperature lower than said second predetermined threshold.

This particularly preferred embodiment of the invention allows to obtain a footwear which is completely customized and adapted to the morphology of the user's foot in all its parts.

Preferably, the footbed is not merely fitted to the user's foot; on the contrary, the footbed, once heated, is inserted into a retaining element made of an elastic material, and the user's foot is fitted into said retaining element, with the footbed inserted therein.

Thanks to the provision of the retaining element made of elastic material, it is guaranteed that the footbed is constantly kept adhering to the user's foot sole and perfectly positioned and aligned with respect to said foot sole, without the risk that the footbed moves while the pressure is being applied.

A kit for carrying out the method according to the invention for the customization of a footwear having an upper which is partially or totally made of a thermoformable material may comprises at least:

- heating means, arranged for heating said thermoformable material until bringing its temperature above said first predetermined threshold;
- shaping means, arranged for applying to said footwear a positive pressure or a negative pressure (vacuum) sufficient to make the thermoformable material adhere to the user's foot and to modify its shape accordingly;
- wherein said heating means are arranged for selectively heating one or more portions of said footwear, while leaving the remaining portions of said footwear at a substantially unchanged temperature.

The heating means may be arranged for simultaneously heating said one or more portions of said footwear from the inside and from the outside of the footwear.

When the method of the invention also provides for the customization of a footbed, partially or totally made of a thermoformable material, it is evident that the heating means and the shaping means of the kit can also advantageously be used for thermoforming said footbed.

In such case, the kit further comprises at least one elastic retaining element for retaining and aligning the footbed to the user's foot sole during the shaping step. Preferably, said kit comprises a plurality of elastic retaining elements having different shapes and sizes for footbeds having different shapes and sizes.

The kit may further comprise:

- a heating unit connectable to the power mains and further connectable to the heating means;
- a source of pressure medium connectable to the shaping means;
- a control unit for controlling said heating unit and said pressure medium source.

In this case, the kit is completely self-operating and capable of carrying out all the steps of the method for the customization of a footwear according to the invention.

The kit for carrying out the method according to the invention can be made in a compact and transportable form: all the components of the kit according to the invention are received in a compact and transportable outer casing, such as a trunk, a suitcase, or a trolley.

Although the invention can be applied to footwear comprising an upper which is totally made of a thermoformable material, it is especially applied to the customization of footwear comprising an upper which comprises only one or more portions made of a thermoformable material, where it is essential to adapt said portion(s) of thermoformable material to the morphology of the user's foot without affecting or damaging the remaining portions of the footwear.

In this case, the portions made of thermoformable material will be provided at the most sensitive regions for the user's comfort, such as the region of the malleoli, the region of the metatarsus and the like. The heating elements of the heating means of the kit according to the invention will be advantageously shaped for matching said regions.

Analogously, in case the footbed is only partially made of thermoformable material, the regions of thermoformable material will be provided at the most sensitive regions for the user's comfort, such as at the region of the plantar arch.

Although the invention can be applied to separate (i.e. separately manufactured and marketed) footwear and footbeds, it is specially applied to the customization of a footwear which has an upper which is partially or totally made of thermoformable material, and which is manufactured and marketed together with its own footbed, which is partially or totally made of thermoformable material.

It is to be intended that herein "thermoformable material" means a polymer-based material which, when heated to a sufficient temperature, can be brought to a viscous state in which it can be shaped. In particular, herein "thermoformable material" is intended to comprise both thermoformable polymers and composite materials in which thermoformable polymers are mixed or filled with additives (e.g. fibers).

It is to be further intended that herein by "inside" of the footwear it is meant the space inside the footwear intended to accommodate the user's foot, while by "outside" it is meant the surrounding environment.

BRIEF DESCRIPTION OF THE DRAWINGS

Further features and advantages of the invention will become more evident from the following detailed description of a preferred embodiment thereof, given by way of non-limiting example with reference to the accompanying drawings, in which.

DETAILED DESCRIPTION

The invention relates to a method for the customization of a footwear, more particularly a sports footwear, which comprises a sole and an upper and in which said upper is made, either partially or totally, of a thermoformable material, by thermoforming said thermoformable material.

Figure 1A:
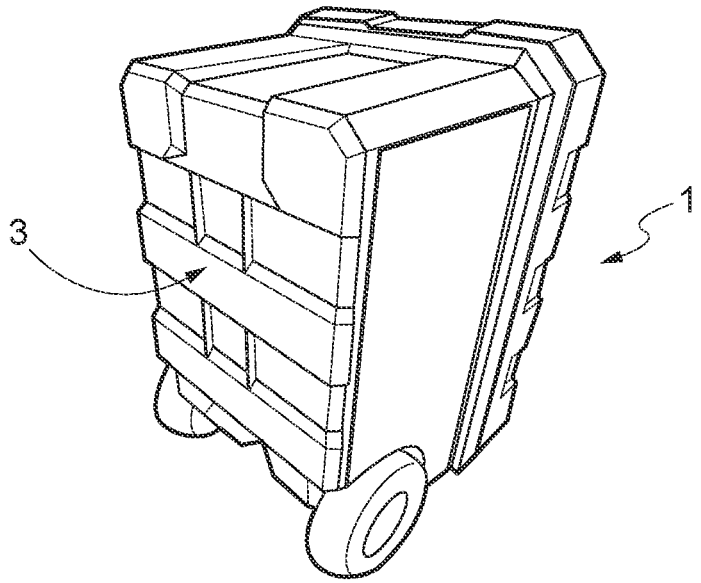
FIGS. 1*a* and 1*b* show a kit for carrying out the customization of a footwear according to the method of the invention.
Figure 1B:
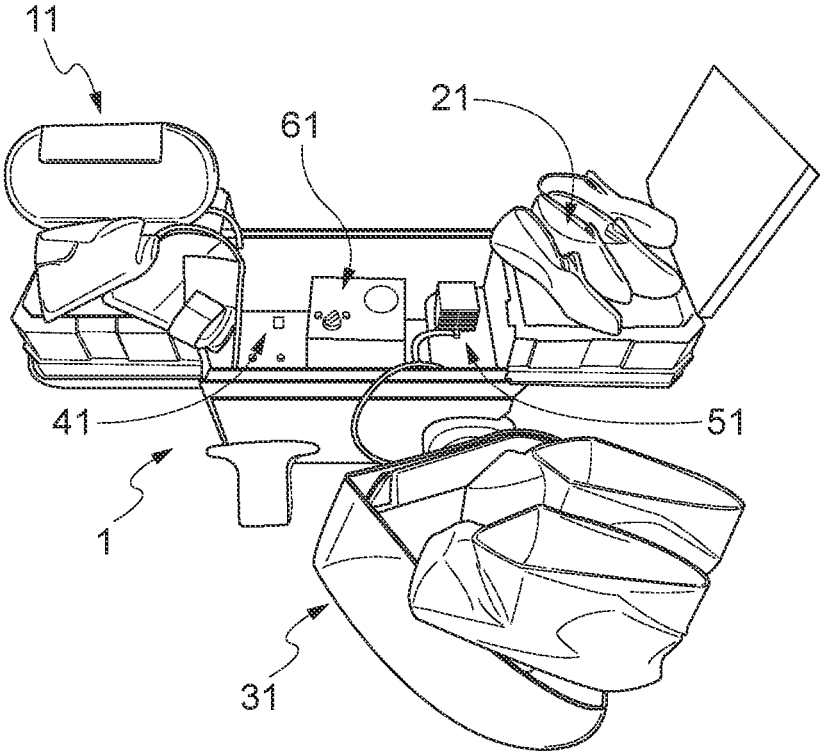

This method can be carried out by a kit which is schematically shown in FIGS. 1*a* and 1*b*.

The kit 1 according to the invention is made in a compact, preferably transportable form and comprises an outer casing 3 which receives in its inside all the components of said kit. Said outer casing 3 is made, for instance, as a trunk, a suitcase or a trolley.

Heating means 11 and shaping means 31, the operation of which will be disclosed in detail below, are received inside the outer casing 3.

The heating means may be electric heating means and in this case the kit 1 further comprises a heating unit 41 which is connectable to said heating means 11. Said kit 1 further comprises a pressure medium source 51 which is connectable to said shaping means 31.

The kit 1 may comprise a control unit 61 for management and control of the heating unit 41 and of the heating means 11 connected thereto, as well as of the pressure medium source 51 and of the shaping means 31 connected thereto. The control unit 61 allows/prevents the electric connection between the heating unit 41 and the various heating elements of the heating means 11 and it further sets, monitors and adjusts the temperature of said heating elements; in addition, the control unit 61 allows/prevents the pneumatic connection between the pressure medium source 51 and the various shaping elements of the shaping means 31 and it further sets, monitors and adjusts the pressure of said shaping elements.

The kit 1 may further comprise elastic retaining elements 21 for the footbed of a footwear, the function of which will be explained in detail below.

Figure 2A:
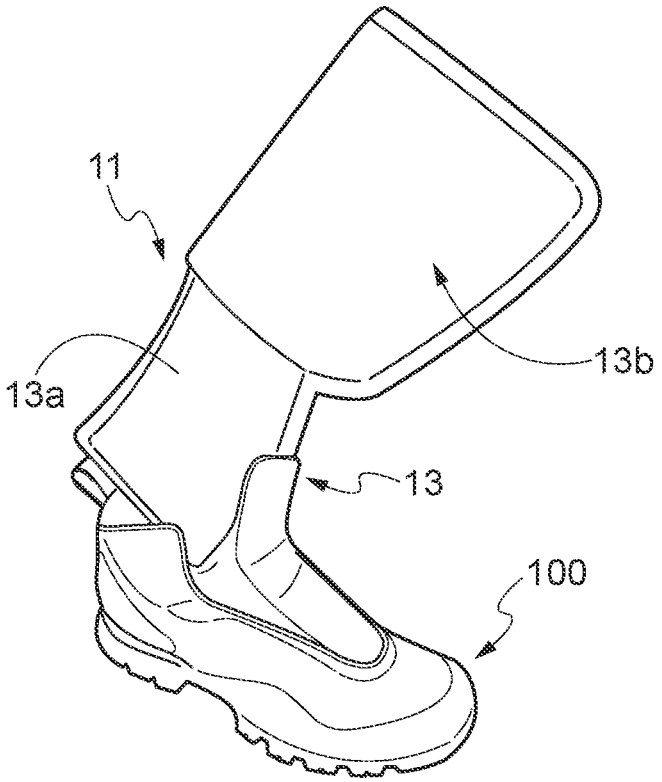
FIGS. 2*a* and 2*b* show the heating step of the method for the customization of a footwear according to the invention.
Figure 2B:
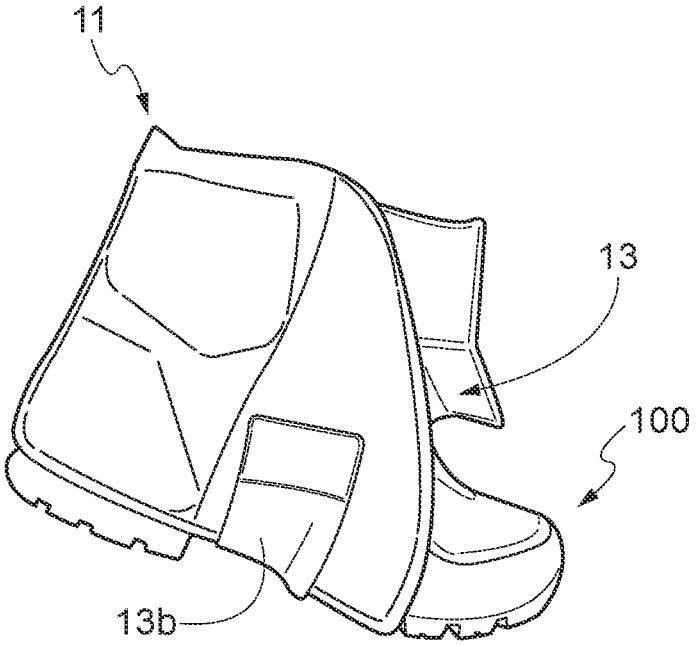

With reference to FIGS. 2*a* and 2*b*, the method according to the invention provides for providing a footwear 100 with an upper which is totally or partially made of a thermoformable material. More particularly, in the shown embodiment the footwear 100 is a sports footwear (namely a hiking footwear), which comprises only some portions made of thermoformable material, namely at the malleoli region and at the metatarsus region, the remaining portions of the footwear being made of different, non-thermoformable materials.

Typically, a pair of footwear 100 will be provided, for the right foot and for the left foot of the user, respectively.

The method according to the invention provides for selectively heating the portions made of thermoformable material of the footwear 100, while leaving the remaining portions of the footwear at a substantially unchanged temperature, and more particularly while leaving at a substantially unchanged temperature those portions of the footwear 100 in which glues or other components that could deteriorate if subjected to high temperature are provided.

Correspondingly, the kit for carrying out the method according to the invention comprises heating means 11 for selectively heating said portions made of thermoformable material of the upper of the footwear 100.

Said heating means 11 comprise at least one flexible heating element 13, which contains in its inside electric resistances and which is shaped so as to fit to said portion made of thermoformable material.

During the heating step the portions made of thermoformable material of the footwear 100 are sandwiched between a pair of portions of the heating element, so that they are simultaneously heated from both sides. Such arrangement allows to bring the thermoformable material to the desired temperature in a shorter time and while keeping the temperature of the heating element 13 limited, which involves energy saving, avoids the risk of accidents (burns) of the operator and—above all—helps to avoid a temperature increase of the remaining portions of the footwear (even in the vicinity of the portions made of thermoformable material).

Accordingly, the heating element 13 includes two heating portions, a first heating portion 13*a* which is shaped so as to be inserted into the upper of the footwear 100 and heat the portions made of thermoformable material from the inside (FIG. 2*a*) and a second heating portion 13*b* which is shaped so as to wrap the upper of the footwear 100 and heat the portions made of thermoformable material from the outside (FIG. 2*b*).

Advantageously, a pair of heating elements 13 can be provided, one for the right footwear and the other one for the left footwear, whereby heating of both footwear can take place simultaneously.

As an alternative, the heating means 11 could comprise two separate heating elements, a first heating element shaped for being inserted into the upper of the footwear and a second heating element shaped for being wrapped around the upper of the footwear (or a pair of thus shaped first heating elements and a pair of thus shaped second heating elements, for the right footwear and the left footwear respectively).

The heating elements 13*a*, 13*b* are connectable to a heating unit, such as an electric heater, for increasing the temperature of the electric resistances. Said heating unit can be a component of the kit 1 according to the invention (FIG. 1*b*) or it can be an external, self-standing device.

Figure 3A:
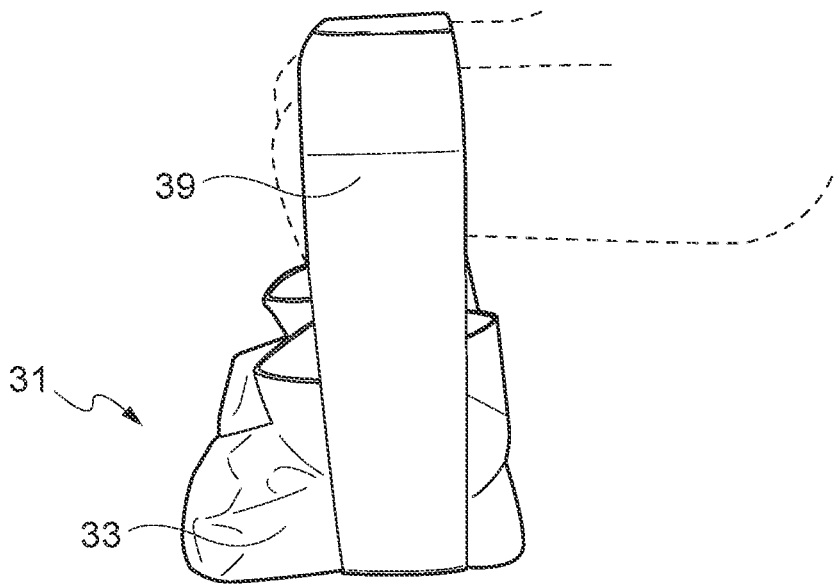
FIGS. 3*a* and 3*b* show the shaping step of the method according to the invention.
Figure 3B:
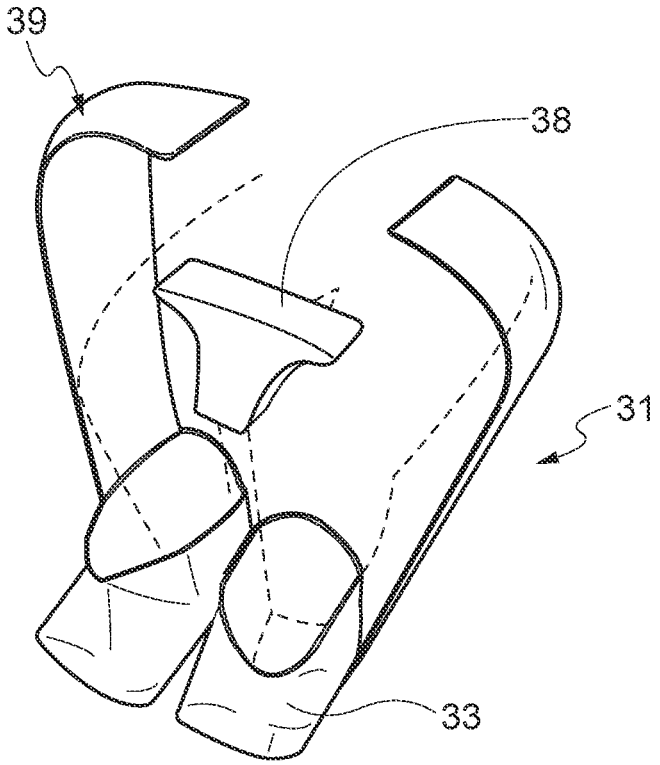

With reference now to FIGS. 3*a* and 3*b*, the method according to the invention provides for making the user fit his/her foot into the footwear 100 and inserting said footwear 100—while the temperature of the portions made of thermoformable material is above the above-mentioned first threshold—into shaping means 31 arranged for applying to the user's foot a pressure sufficient for modifying the shape of said portions made of thermoformable material so as to adapt it to the specific morphology of the user's foot.

The user's foot is kept inside the shaping means and is subjected to said substantially constant pressure until the temperature of the portions made of thermoformable material decreases below the above-mentioned first threshold, i.e. below the softening temperature of said thermoformable material.

Figure 4:
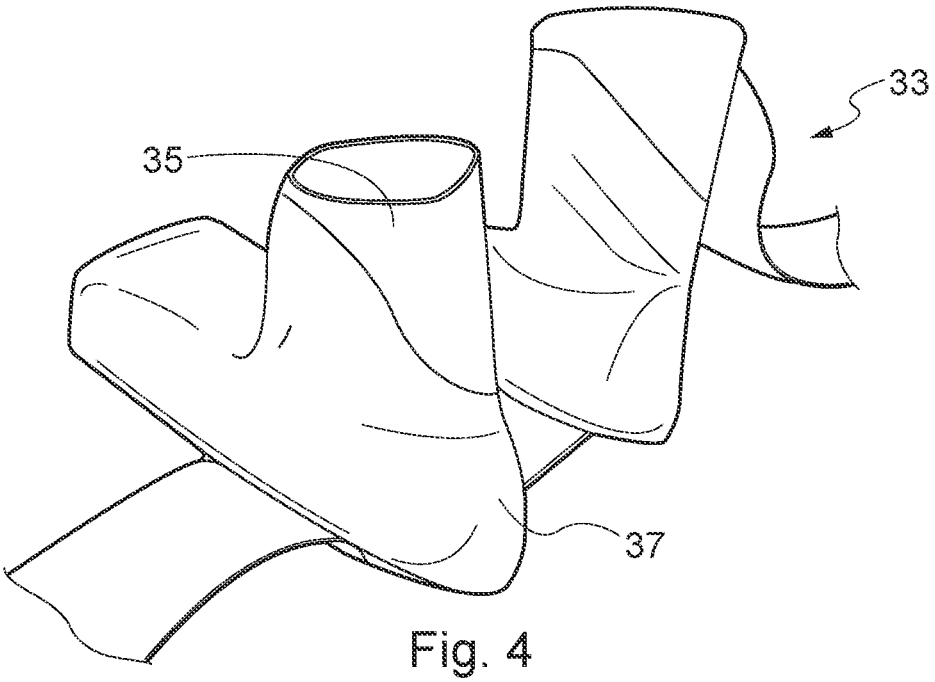
FIG. 4 shows the shaping means used for carrying out a preferred embodiment of the method according to the invention.

In FIG. 4, the shaping means 31 are shown in greater detail.

Said shaping means 31 comprise at least one shaping element 33 and, more preferably, a pair of shaping elements, whereby the shaping of the right footwear and of the left footwear can take place simultaneously.

Each shaping element 33 comprises an inner housing or inner sack 35, suitable for receiving the user's foot, and an outer housing or outer sack 37, defining together with the inner sack a gap that is connectable to a source of pressurized medium, such as air.

The pressure medium source can be, for instance, an electric compressor which can be connected to the power mains and which can be a component of the kit 1 according to the invention (FIG. 1*b*) or an external, self-standing device.

By introducing the pressure medium into the gap, an increasingly higher pressure can be applied to the user's foot received in the inner sack 35. More particularly, by introducing an appropriate amount of pressure medium into the gap, a sufficient pressure can be applied to the portions made of thermoformable material of the upper of the footwear 100, while they are kept in contact with the user's foot, for causing them to deform and adapt to the morphology of the foot of said user; such a pressure is maintained until cooling of the thermoformable material.

Advantageously, use of elements suitable for guaranteeing that the user maintains the correct position during the step of shaping the footwear 100 may be provided.

More particularly, as shown in FIG. 3*b*, the user will fit his/her feet into the shaping elements while sitting, with his/her femurs in a substantially horizontal position, and a strap 39 will be passed under the shaping elements 33 and around the user's knees and it will be closed so as to form a ring around the user's legs. The strap 39 prevents the pressure in the gap between the sacks 35, 37 of the shaping elements 33 from pulling the user's feet out of said shaping elements. Moreover, the strap 39 guarantees that the pressure applied to the user's feet is constant and equal to the desired value, irrespective of the user's weight.

In addition, or in alternative to the strap 39, the kit 1 may comprise a knee spacer 38 (which can be seen in FIG. 3*b*), the function of which is to keep the user's legs parallel to each other, avoiding rotations and misalignments during the shaping step.

In the shown embodiment, the footwear 100 is provided with a footbed, partially or totally made of thermoformable material, and the method according to the invention provides for adapting the shape of said footbed to the specific morphology of the user's foot sole by thermoforming.

Figure 5:
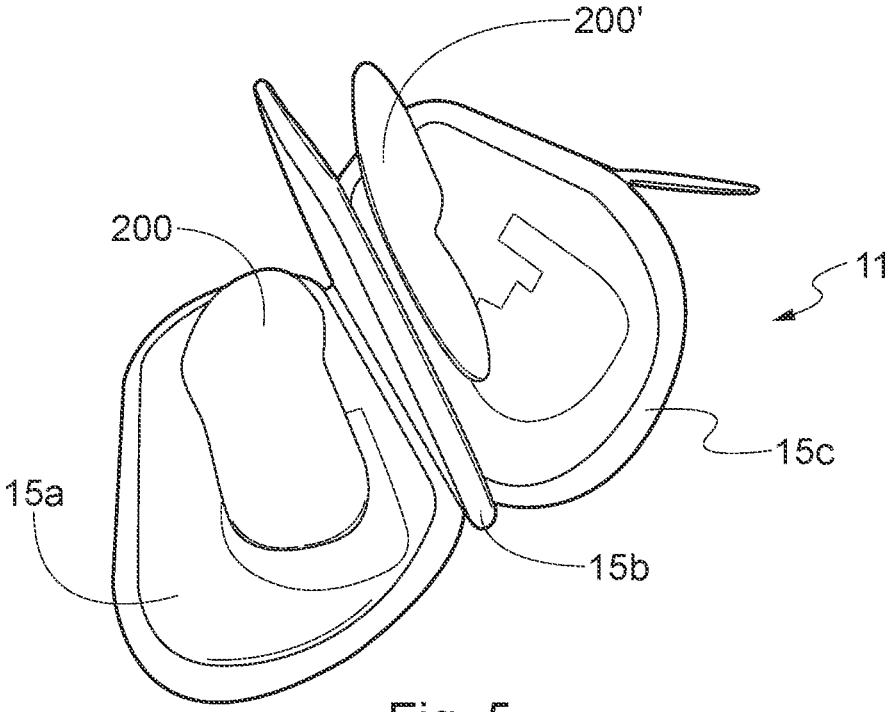
FIG. 5 shows the step of heating the footbed of the method according to the invention.

With reference to FIG. 5, typically a pair of footbeds 200, 200' will be provided, for the right foot and for the left foot of the user, respectively.

The method according to the invention provides for heating the footbed 200, 200' until bringing its temperature above a second predetermined threshold, equal to or higher than the softening temperature of the thermoformable material.

Correspondingly, the heating means 11 of the kit 1 according to the invention will comprise further heating elements for heating the footbeds.

Preferably, during the heating step the footbed is sandwiched between a pair of heating elements, so as to be simultaneously heated from both sides.

Correspondingly, the heating means 11 comprise three further heating elements, namely a middle heating element 15*b* and a pair of lateral heating elements 15*a*, 15*c*: in this way both footbeds can be simultaneously heated, by sandwiching a first footbed 200 between the middle heating element 15*b* and a first lateral heating element 15*a* and the second footbed 200' between the middle heating element 15*b* and the second lateral heating element 15*c*.

Figure 7:
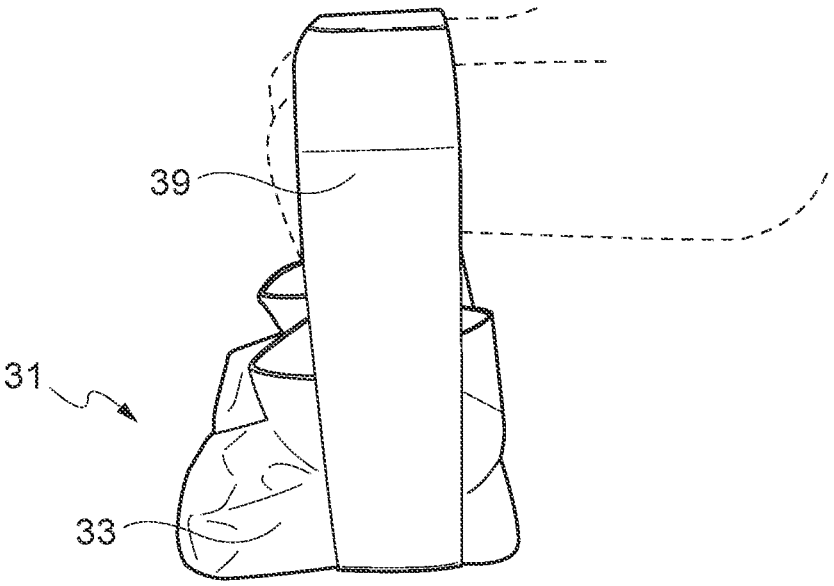
FIG. 7 shows the step of shaping the footbed of the method according to the invention.

With reference to FIG. 7, the footbed 200, 200'—while its temperature is maintained above the above-mentioned second threshold—is fitted to the foot sole of the user and the user's foot is inserted into the shaping means 31, in which it is subjected to a pressure sufficient to make the footbed adhere to the user's foot sole and to modify its shape for adapting it to the specific morphology of the user's foot.

The step of shaping the footbed takes place in a way completely similar to what described above with reference to the footwear and the above-mentioned pressure is maintained, at a substantially constant level, until the footbed temperature decreases below the second predetermined threshold, corresponding to the softening temperature of the thermoformable material.

Figure 6:
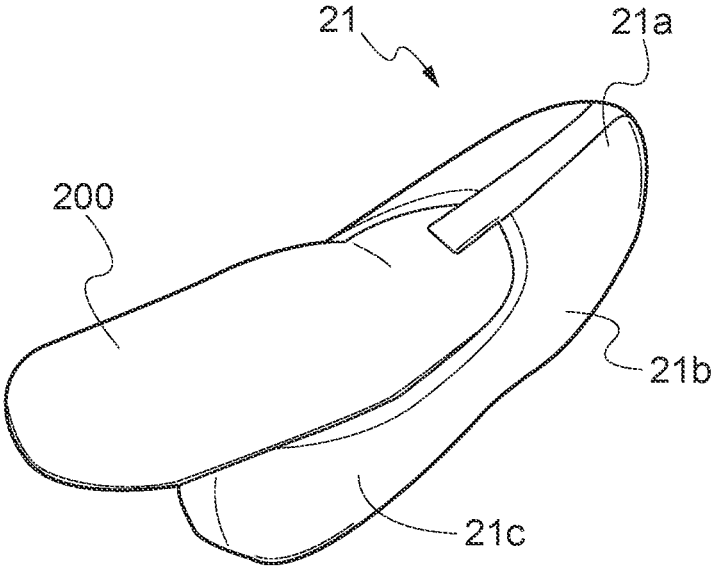
FIG. 6 shows the step of inserting the footbed into the elastic retaining element of the method according to the invention.

In the particularly preferred embodiment shown in the Figures, during the shaping step the footbed 200, 200' is not merely fitted to the user's foot sole. On the contrary, as shown in FIG. 6, said footbed is previously inserted into a retaining element 21 made of elastic material.

Said elastic retaining element 21 is shaped so as to comprise a foot sole portion 21*b*, suitable for covering the region of the user's foot sole, a heel portion 21*c*, suitable for wrapping, at least partially, the region of the user's heel, and a toe portion 21*a*, suitable for wrapping, at least partially, the region of the user's toes, so as to receive the footbed and effectively hold it in place against the user's foot sole. Said elastic retaining element can be made, for instance, in the shape of a sock (so-called "footlet") or of a soft shoe (so-called "ballet flat").

During the above-described shaping step, the provision of the elastic retaining element 21 ensures that the footbed 200, 200' is constantly maintained adhering to the user's foot sole and guarantees that said footbed is correctly positioned and aligned with respect to said foot sole.

Preferably, the kit 1 will comprise a pair of elastic retaining elements 21, one for each (right and left) footbed 200, 200' of the pair of footbeds.

Even more preferably, the kit 1 will comprise a plurality of elastic retaining elements—or a plurality of pairs of elastic retaining elements—of different shapes and sizes for footbeds of footwear of different sizes.

It is to be noted that, in case the method according to the invention provides for the thermoforming of footbeds, such thermoforming of footbeds will take place before the thermoforming of footwear and the step of shaping the footwear will take place with the (already customized) footbeds inserted inside the footwear.

It will be evident from the above disclosure that the method according to the invention achieves the objects set forth above, as it allows to completely customize to the foot of each single user any footwear having an upper which comprises one or more portions made of thermoformable material.

It will be apparent to the person skilled in the art that the kit allows to carry out the method according to the invention in a comfortable, quick, and effective way. Indeed, first of all said kit allows to implement the method according to the invention in a completely autonomous way. Secondly, said kit allows to simultaneously carry out different steps of the method according to the invention: for instance, the step of heating the footwear may take place while the user is handling the step of shaping the footbeds, thus achieving an optimization of the time required for the overall procedure.

It will be also evident that the embodiment described above is not to be intended in a limiting sense and that several variants and modifications are possible without departing from the scope of the invention as defined by the appended claims.

In this respect it is to be noted that, although in the foregoing description reference has been generically made to a "thermoformable material", the invention can be applied both to the customization of footwear (and possibly footbeds) comprising one or more portions made of the same thermoformable material and to the customization of footwear comprising portions made of different thermoformable materials and/or provided with footbeds that are partially or totally made of thermoformable material(s) different from the thermoformable material(s) of the footwear upper. In the latter case, the temperature threshold(s) in the heating step (or steps) will be set each time according to the softening temperature of the specific thermoformable material(s) involved.

We claim:

1. A method for the customization of a footwear, more particularly a sports footwear, wherein the footwear comprises an upper and a sole, wherein the upper comprises at least one or more portions made of thermoformable material and the footwear includes at least one portion made of a different, non-thermoformable material, wherein the method comprises:

heating the portions of the upper made of thermoformable material up to a temperature above a first predetermined threshold;

fitting a foot of a user into the footwear;

applying to the footwear, at least at the portions of the upper made of thermoformable material, a pressure sufficient to modify the shape of the portions of the upper made of thermoformable material, adapting them to the morphology of the foot of the user;

while the pressure is being applied, allowing the portions of the upper made of thermoformable material to cool down to a temperature below the first predetermined threshold;

wherein said heating includes selectively heating the portions of the upper made of thermoformable material of the footwear after the footwear is assembled, while leaving the remaining portions of the assembled footwear at a substantially unchanged temperature; and wherein, when heating the portions of the upper made of thermoformable material, the portions of the upper made of thermoformable material are heated on both sides simultaneously, from the outside and from the inside of the upper of the footwear.

2. The method of claim 1, wherein heating the portions of the upper made of thermoformable material of the footwear is carried out with one or more flexible heating element, and the method further comprises flexing the one or more flexible heating element to adapt the one or more flexible heating element to the shape of the portions of the upper made of thermoformable material of the footwear.

3. The method of claim 1, wherein, while the pressure is being applied, the foot of the user is blocked inside the footwear, thus keeping the pressure constant, irrespective of the weight of the user.

4. The method of claim 3, wherein the foot of the user is blocked by a strap, arranged for being wound around the footwear and around the knees of the user.

5. The method of claim 1, wherein, while the pressure is being applied, the legs of the user are kept parallel to each other.

6. The method of claim 1, wherein the method further comprises:

providing a footbed, having a shape and size suitable for being inserted into the footwear and made, either partially or totally, of thermoformable material;

heating the footbed up to a temperature above a second predetermined threshold;

fitting said footbed, thus heated, to the foot sole of the user;

applying to the foot of said user, at least at the foot sole, a pressure sufficient to modify the shape of said footbed of thermoformable material, adapting it to the morphology of said foot sole of said user;

while said pressure is being applied, allowing said footbed to cool down to a temperature below the second predetermined threshold.

7. The method of claim 6, wherein, the footbed, once heated, is inserted into a retaining element made of an elastic material, and the user's foot is fitted into said retaining element, with the footbed inserted therein, whereby the footbed is constantly kept adhering to the user's foot sole and aligned with respect to said foot sole.

8. The method of claim 6, wherein the footbed is simultaneously heated from both sides.

* * * * *